US007228631B2

(12) United States Patent
Denker

(10) Patent No.: US 7,228,631 B2
(45) Date of Patent: Jun. 12, 2007

(54) CONTOURING SHAVE

(76) Inventor: James M. Denker, 711 First Parish Rd., Scituate, MA (US) 02066-3123

( * ) Notice: Subject to any disclaimer, the term of this patent is extended or adjusted under 35 U.S.C. 154(b) by 0 days.

(21) Appl. No.: 10/967,995

(22) Filed: Oct. 19, 2004

(65) Prior Publication Data

US 2005/0081391 A1 Apr. 21, 2005

Related U.S. Application Data

(60) Provisional application No. 60/512,430, filed on Oct. 20, 2003.

(51) Int. Cl.
*B27G 17/00* (2006.01)
*B26B 27/00* (2006.01)

(52) U.S. Cl. ..... 30/169; 30/167.2; 30/478; 30/481; 15/236.1; 144/115

(58) Field of Classification Search ..... 30/167.2, 30/167, 167.1, 169, 177, 179, 191, 486, 493, 30/484, 164.8, 168, 479, 492, 487, 478, 481, 30/480, 294, 277, 367, 775, 482, 280, 339, 30/333, 136, 41, 54, 62, 66, 250; 409/113, 409/118; 7/100, 156, 158, 163; 76/28; 144/115, 144/114.1, 154.4, 48.5, 48.6; 81/463; 15/236.01
See application file for complete search history.

(56) References Cited

U.S. PATENT DOCUMENTS 192,148 A * 6/1877 Buttler ..... 30/167.1
308,709 A * 12/1884 Sinse ..... 451/557
316,296 A * 4/1885 Rodier ..... 30/492
327,312 A * 9/1885 Reinhard et al. ..... 30/167.2
586,164 A * 7/1897 Denere ..... 30/169
678,776 A * 7/1901 Frank ..... 30/167.2
757,317 A * 4/1904 Kinney ..... 30/294
779,392 A * 1/1905 Bjordal ..... 30/487
816,794 A * 4/1906 Harris ..... 30/164.9
879,793 A * 2/1908 Nylund ..... 30/486
898,556 A * 9/1908 Clark ..... 30/486
1,005,637 A * 10/1911 Friebertsha ..... 451/557
1,166,437 A * 1/1916 Collins ..... 30/489
1,687,403 A * 10/1928 McFarlin ..... 30/293
1,753,103 A * 4/1930 Abramson ..... 30/167.2
1,876,782 A * 9/1932 Spyker ..... 30/481
1,877,699 A * 9/1932 Showers ..... 30/167.1
D116,018 S * 8/1939 Cathcard ..... D8/98

(Continued)

*Primary Examiner*—Boyer D. Ashley
*Assistant Examiner*—Ghassem Alie
(74) *Attorney, Agent, or Firm*—Wilmer Cutler Pickering Hale and Dorr LLP

(57) ABSTRACT

The invention is directed to a hand tool for cutting shavings from the surface of a workpiece of wood (or other workable material) to shape and make smooth any three-dimensional surface having concave, flat, and/or convex contours. The thickness of the shavings is modulated by the angular relationship and distance between a blade and a regulating post. An embodiment comprises a combination body and handle holding a protruding cutting blade at an angle of about 30° to the surface of the workpiece, and an adjustable protruding post in front of the cutting edge to limit the effective exposure of the cutting edge as the tool is moved into contact with the workpiece. The embodiments provide a full view of the cutting zone and unrestricted one-hand use on surfaces of any contour.

21 Claims, 5 Drawing Sheets

U.S. PATENT DOCUMENTS 2,199,380 A * 5/1940 Walraven ..... 30/168
2,297,699 A * 10/1942 Moore ..... 409/296
2,311,234 A * 2/1943 Krajnc ..... 82/92
2,484,476 A * 10/1949 Teigland ..... 30/172
2,565,193 A * 8/1951 Aubin ..... 30/492
2,734,535 A * 2/1956 Neubauer ..... 30/481
2,758,619 A * 8/1956 Swanson et al. ..... 30/478
2,780,867 A * 2/1957 Chapla ..... 30/168
2,803,877 A * 8/1957 Belanger ..... 30/317
3,225,443 A * 12/1965 Young ..... 30/273
3,400,458 A * 9/1968 Moore ..... 30/164.9
3,900,058 A * 8/1975 McArdle ..... 81/463
4,010,542 A * 3/1977 Richardson et al. ..... 30/164.9
4,295,273 A * 10/1981 Matthews ..... 30/293
4,358,893 A * 11/1982 Stanfield ..... 30/280
4,449,299 A * 5/1984 Mulrooney ..... 30/169
D274,121 S * 6/1984 O'Neill et al. ..... D8/98
4,821,419 A * 4/1989 Lee ..... 30/493
4,866,847 A * 9/1989 Batrack et al. ..... 30/293
4,890,351 A * 1/1990 Wilson ..... 15/236.1
5,136,786 A * 8/1992 Calagui ..... 30/478
5,478,328 A * 12/1995 Silverman et al. ..... 604/272
5,501,015 A * 3/1996 Harvey ..... 30/164.9
5,595,424 A * 1/1997 Nakagawa ..... 30/169
5,694,696 A * 12/1997 Lee et al. ..... 30/488
6,718,642 B2 * 4/2004 Collins ..... 30/492
2002/0044844 A1 * 4/2002 Andronica ..... 408/199
2004/0098865 A1 * 5/2004 Anderson ..... 30/169

* cited by examiner

Fig. 7
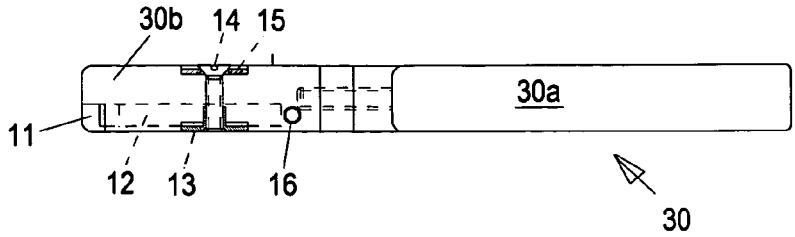
Fig. 8
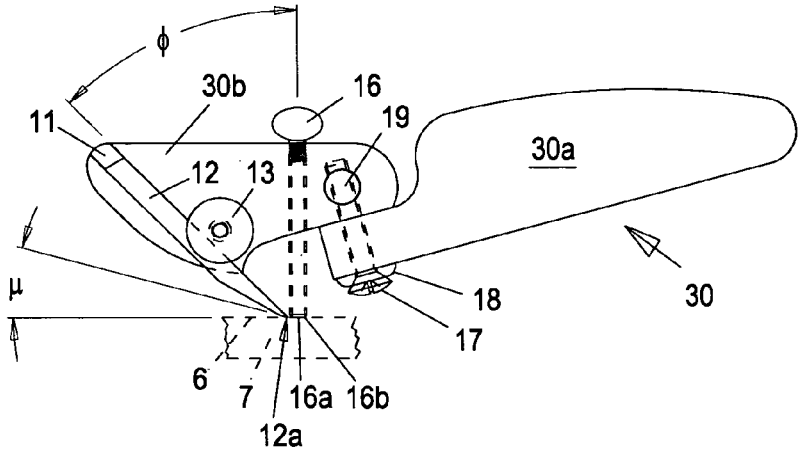
Fig. 9
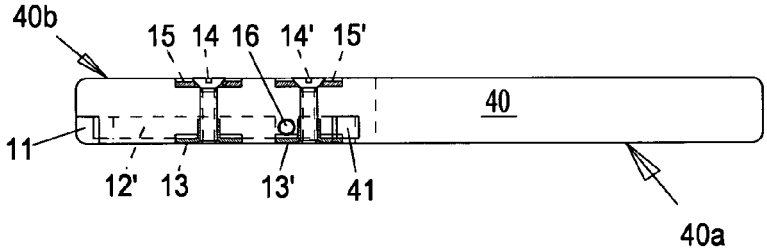
Fig. 10
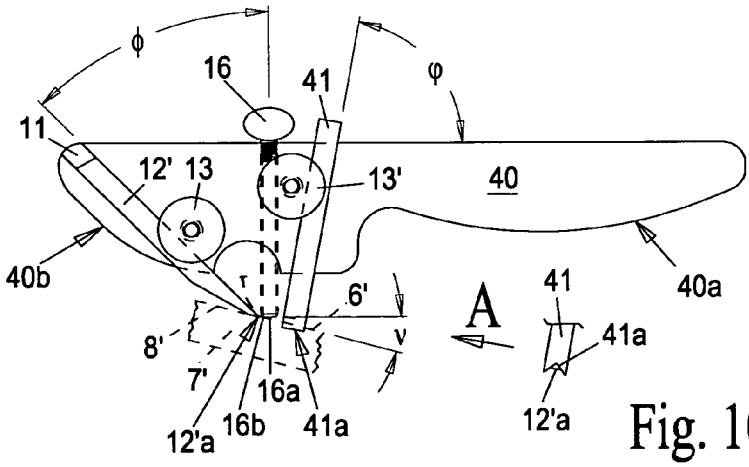
Fig. 10A

Fig. 11
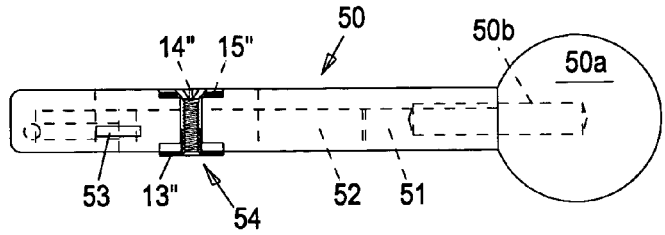
Fig. 12
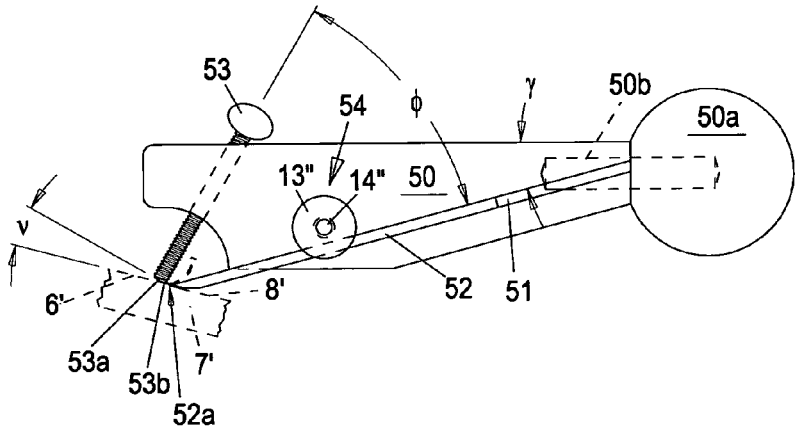
Fig. 13A
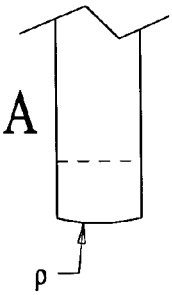
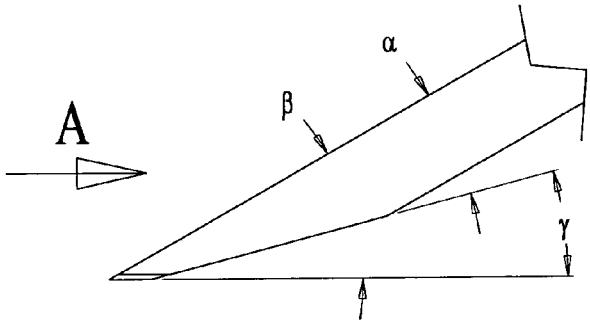
Fig. 13

CONTOURING SHAVE

CROSS-REFERENCE TO RELATED APPLICATIONS

This application claims the benefit of U.S. Provisional Patent Application Ser. No. 60/512,430 filed Oct. 20, 2003, the entire contents of which is incorporated herein by reference.

TECHNICAL FIELD

This invention relates generally to the field of woodworking tools.

BACKGROUND

In the hands of a skilled woodcarver, chisels and gouges are an excellent (and sometimes the only) hand tools that can cut virtually any contour on a workpiece. They are best used to cut specific shapes and details while working to layout lines, and for incising away sizeable chunks of waste material quickly. Often a mallet is used to drive the cutting edge into the wood. These tools are not as well suited to working areas of freeform surfaces to continuously blended finished contours, a task best performed by a tool that merely shaves or planes the surface, rather than cutting deeply into the wood under the skillful guidance, control, and physical effort of the woodcarver.

There are a great many designs and styles of woodworking hand planes and spokeshaves that have been developed over time, all to perform the same basic operation on a workpiece of wood or other workable material. That operation is to remove thin shavings of controlled thickness from a rough and/or uneven surface to render it smooth and even. When a perfectly flat surface is the objective, there are many designs to accomplish this task. From ancient wood-block planes to the most modem metal hand planes in current production, all have the same two features in common: a planar sole surface and a sharp-edged blade (traditionally called an "iron") protruding slightly from the sole surface to shave material only from those areas of the workpiece that can come into physical contact with the sole.

In some cases, a convex surface or a concave surface must be made accurate in form and smooth in appearance. If the surface is cylindrical, a plane having a sole of complementary (matching) cylindrical curvature and a straight-edged iron can be used in the same manner as flat-soled planes are used on a planar surface. There are even some designs for planes with flexible soles that can be adjusted to match a desired curvature, and multi-piece soles whose elements can be positioned in relation to each other so they all will be in contact only with a certain cylindrical surface.

In general, a plane is adapted for work on a given flat, concave, or convex surface by machining its sole (the surface that contacts the workpiece) to have a complementary contour; i.e., flat, convex, or concave respectively. For compound-curved surfaces, the cutting edge of the blade can also be curved. Obviously, planes having flat or concave soles have limited utility on free-form three-dimensional surfaces because they can engage and cut only convex surfaces whose radius of curvature is less than that of the sole or the cutting edge. Work on any given three-dimensional free-form surface requires a plane having both a convex sole and a convex edge, each having a radius of curvature less than or equal to the smallest concave radius of curvature anywhere on the surface.

The cutting conditions on a three-dimensional compound-curved surface are quite different than on either planar or cylindrical surfaces. The sole of the plane is not in full contact with the work surface. Rather, contact occurs only in the vicinity of the mouth, through which the cutting edge of the iron protrudes. In order to maintain smooth cutting conditions, the plane must be guided over the work surface in such a way that the mouth is kept tangent to the work surface at all times. Sight and feel must be relied upon to selectively remove material only from those areas that are proud of the desired finished contour. The curvature of the sole has no influence upon the curvature of the surface of the workpiece unless the sole can come into substantially full contact with that surface.

A plane taking a full-width chip in hardwood, or even most softwood, requires a lot of force to push (or pull). For this reason, bench planes, with irons from 1.75 inches up to 2.63 inches in width, are designed to be held and used with two hands. Block planes are designed to be held and used with just one hand, and their irons are generally 1.38 inches wide, and not more than 1.63 inches wide, in order to limit the maximum force required to push the tool. They are often used to chamfer edges and corners, which limits the width of the chip and thereby minimizes the force required. However, when used to plane a flat surface, a block plane becomes much harder to push and control with just one hand, so the other hand is often needed to assist the gripping hand.

Aside from undesirably high force requirements, planes also have another characteristic that can cause great difficulty. Cutting "with the grain" is a term all woodworkers come to know and understand. This is especially important to the proper functioning of a plane, because cutting "against the grain" causes the iron to dig into the wood, lifting the fibers and splitting them apart ahead of the cutting edge rather than cutting them cleanly. Such a split will always extend below the line of cut, and the finished surface will have a defect (crater) in it that is called a "tear out". In straight-grained woods, cuts can easily be made with the grain by good judgment gained from experience, and so-called "paring cuts" made across the grain at about a 45° angle to either side. However, there are woods having a curly grain pattern, such as Bird's Eye Maple and Tiger Maple, that cannot be planed in any direction without going against the grain in some portion of any cutting stroke. Here it is essential that the plane be able to cut freely and continuously without any tendency to "catch", "dig-in", or "stall in the cut" (common descriptive terms for typical interruptions of the cutting process). Whenever such an interruption occurs, it is likely to produce a tear-out in the surface. It should be noted that the lower the cutting force, the easier it is to control and maintain ideal cutting conditions at the cutting zone.

SUMMARY OF THE INVENTION

According to one aspect of the invention, a hand tool (shave) includes a housing, a handle portion, and a working portion with a blade rigidly mounted from the working portion of the housing. The blade has a sharp cutting edge at the protruding end, and a regulating post both rigidly and adjustably mounted in and protruding from the working portion of the housing. The embodiments include a regulating post which has a workpiece-engaging surface at its outer end that is closely proximate to but spaced apart from and generally aligned with said cutting edge of said blade.

The distance between the cutting edge and a proximate portion of the regulating post is approximately in the range of 0.0002 meters (0.010 inches) to 0.0007 meters (0.030 inches). Alternately, the distance between the cutting edge and a proximate portion of the regulating post is in the range of approximately 0.003 meters (0.125 inches) to 0.0008 meters (0.035 inches). The blade has a primary flat bevel and a secondary cylindrical bevel that defines a crowned cutting edge. According to certain embodiments of the invention, the primary flat bevel of said cutting edge is in the range of approximately 20 to 30 degrees. The cutting blade is made from a standard sized, industrial, pre-hardened and pre-ground blank tool bit. In an alternate embodiment, the blade is an ordinary wood chisel.

Another aspect of the invention includes the working portion being made from either metal and wood. In an embodiment, the working portion is made from an aluminum alloy.

The regulating post is adjusted to increase or decrease the thickness of the shavings removed from the workpiece surface. The blade and regulating post are positioned at an angular relationship with respect to each other, and the angle between the blade and the post is approximately 45° or be in the range of approximately 30°–60°.

In another aspect of the invention, the blade has a heel clearance with respect to a workpiece surface to optimize either a contouring or cutting function. The heel clearance is approximately 15 to 30°. The distance between the cutting edge and a plane defined by the surface of the working portion from which both the blade and regulating post protrude is greater than 0.006 meters (¼"). Alternately, this distance ranges between ⅜" to ⅞" or ½" to ⅝".

The body member adjustably locates and holds fixedly a lateral guide member. This guide member can be held in the form of a 90° V in close proximity to the workpiece-engaging surface of the regulating post, and the blade has a primary flat bevel and a secondary flat bevel that defines a straight cutting edge. Alternately, the body member adjustably locates and holds fixedly a lateral guide member in the form of a 90° V in close proximity to the workpiece-engaging surface of the regulating post, and the blade has a primary flat bevel and a secondary flat bevel that defines a straight cutting edge that is centrally notched at the same secondary bevel angle with a quarter-circle arc of arbitrary radius.

The foregoing and other features and advantages of the invention will be apparent from the following more particular description of embodiments of the invention, as illustrated in the accompanying drawings in which like reference characters refer to the same parts throughout the different views. The drawings are not necessarily to scale, emphasis instead being placed upon illustrating the principles of the invention.

BRIEF DESCRIPTION OF THE DRAWINGS

FIG. 7 is a plan view of a third embodiment of the invention. For clarity, and because broken lines are impractical to clearly depict such small elements, the blade-clamping fastener assembly only is shown in partial section, as if the body member were transparent.

FIG. 8 is an elevation view of the same third embodiment shown in FIG. 7. For clarity, and because there is no ambiguity, the section line and arrows indicating the viewing direction have been omitted regarding FIG. 7.

FIG. 9 is a plan view of a fourth embodiment of the invention. For clarity, and because broken lines are impractical to clearly depict such small elements, the two clamping fastener assemblies are shown in partial section, as if the body member were transparent.

FIG. 10 is an elevation view of the same fourth embodiment of the invention shown in FIG. 9. For clarity, and because there is no ambiguity, the broken section line and arrows indicating viewing direction have been omitted regarding FIG. 9.

FIG. 10A is a partial frontal elevation view of the guide bar of the fourth embodiment shown in FIG. 10, looking in the direction of arrow A, which is parallel to the direction of forward cutting movement but looking rearward.

FIG. 11 is a plan view of a fifth embodiment of the invention. For clarity, and because broken lines are impractical to clearly depict such small elements, the blade-clamping fastener assembly only is shown in partial section, as if the body member were transparent.

FIG. 12 is an elevation view of the same fifth embodiment of the invention shown in FIG. 11. For clarity, and because there is no ambiguity, the broken section lines and arrows indicating viewing direction have been omitted regarding FIG. 11.

FIG. 13 is a side elevation view of the cutting edge and the adjoining portion of the blade.

FIG. 13A is a front elevation of the cutting edge and the adjoining portion of the blade shown in FIG. 13, viewed in the direction indicated by arrow A, which is parallel to the direction of forward cutting movement but looking rearward.

DETAILED DESCRIPTION

Figure 1:
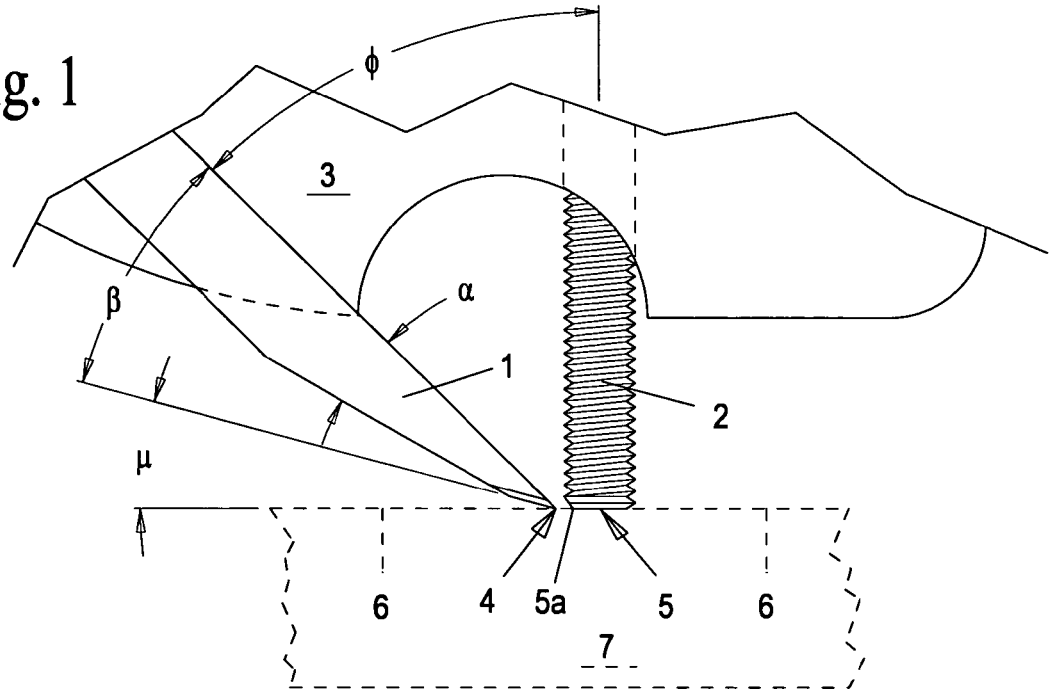
FIG. 1 is an enlarged side elevation of a blade and regulating (toe) post, showing the positional relationship of the cutting edge, the cutting edge bevel, and the flat end of the post, with both elements just touching (but the edge not cutting) a workpiece.

The embodiments of the invention include the use of two working elements, a cutting blade and an adjustable post in front of and closely proximate to the cutting edge to regulate and limit the depth of the cut. The end surface of the post is substantially flat, although it need not be, and is so positioned that when sighting across the flat, the cutting edge is just barely visible. If this flat end is brought into substantially full contact with a workpiece surface, the cutting edge is also just touching the workpiece. As the tool is tilted backwards with respect to the forward (cutting) direction, more of the cutting edge is exposed beyond the edge of the end surface of the post. This causes the thickness of the chip to increase in proportion to the angle of tilt. However, the tool can be tilted back only to the attitude where the sharpening bevel (defining the cutting edge of the blade) becomes parallel to and just begins to come into full contact with the freshly cut surface of the workpiece just behind the cutting edge. Any further backward tilt causes the cutting edge bevel surface to direct the cutting path up and out of the workpiece, thereby terminating the cut.

The embodiments of the invention recognize that in order to improve upon the cutting ability, ease of use, and the material removal performance of existing hand planes and spokeshaves to smooth and shape rough three-dimensional surfaces, it is necessary to (1) greatly lower the required cutting force, (2) maximize the rigidity of the blade with respect to the sole, (3) optimize the ergonomics of the tool to facilitate the following of complex surfaces while maintaining proper cutting conditions, (4) ensure that the cutting edge of the iron is truly sharp, can retain sharpness in extended heavy use, and can be easily renewed with minimum interruption of work whenever the edge begins to dull, and (5) improve visibility of the cutting process to enable the tool user to more easily judge material removal progress and accurately determine where further material removal is needed.

The embodiments of the invention also maximize the capability to cut and remove material without sacrificing full control of the cut. Productivity is directly dependent upon the number of cutting strokes that can be performed per unit of time. Good visual and tactile feedback from the tool can greatly reduce the wasted time between strokes, while improving the accuracy and quality of the completed workpiece.

There is always the aspect of safety in the use of any tool having a sharp cutting edge. The embodiments to not lend themselves readily to improper use and minimize the potential injury to the user in the event of a slip, attempted misuse, or merely just simple carelessness. This requires the cutting edge to be inherently well guarded, so that the user should need no special cautionary warnings regarding safe use of the tool.

The embodiments of this invention derive their performance advantages not only from the ergonomic design features, but also from the redundant elements that have been eliminated by their design. While all prior art involves some sort of surrounding frame, either full or partial, to support and hold the cutting blade in relation to the toe and/or heel portions of the guiding sole surface(s), the present invention eliminates all such surrounding structure. The blade and its cutting edge are fully visible so the tool user can see the workpiece surface directly and observe the chip as it is being cut, just as when using a chisel or a gouge, but unlike all other shaves and planes of traditional construction. In fact, visibility of the cutting edge is comparable to that of the scorp, an old but obscure carving tool for one-handed use that is similar in function to the more widely known inshave, a two-hand tool used for scooping-out larger hollows such as wooden gutters, bowls, and chair seats. These ancient tools both have a curved cutting edge facing towards the user, so cutting is done by pulling, rather than by pushing, but their cutting action is otherwise the same as that of any ordinary chisel or gouge. It is, of course, possible to use these tools in a backhanded manner, but this is awkward and would be done only when made necessary by obstructions in the vicinity of the work area.

Referring now to FIG. 1, there is shown a partial tool assembly in accordance with an embodiment of the invention comprising a typical fixedly mounted cutting blade 1 and a threaded adjustable regulating post 2, both located and held by body 3 so that the cutting edge 4 of blade 1 is aligned with the plane of the end surface 5 of the post 2 and is spaced approximately 0.030 inches from the outside diameter 5*a* of the end surface 5 of post 2. An existing outer surface 6 of workpiece 7 of wood (or other appropriate workable material) is shown in contact with both the flat end surface 5 of post 2 and the cutting edge 4 of blade 1. It should be noted that if the blade 1 is mounted in the body 3 at an angle $\phi$ of approximately 45° to the axial centerline of post 2 as shown and has a cutting edge bevel $\beta$ of approximately 30° included angle, the effective relief angle $\mu$ behind cutting edge 4 is approximately 15°.

If the tool is moved forward (left to right as shown in this view), no cutting can occur because cutting edge 4 is constrained by post 2 to remain just barely touching the existing outer surface 6 of workpiece 7. If, however, the tool is tilted backwards (rotated counterclockwise as shown in this view), the cutting edge 4 can now start to cut into surface 6 of workpiece 7, cutting deeper and deeper until the edge 5*a* of the end surface 5 of post 2 again contacts surface 6 of workpiece 7, thereby limiting any further increase in cutting depth.

Figure 2:
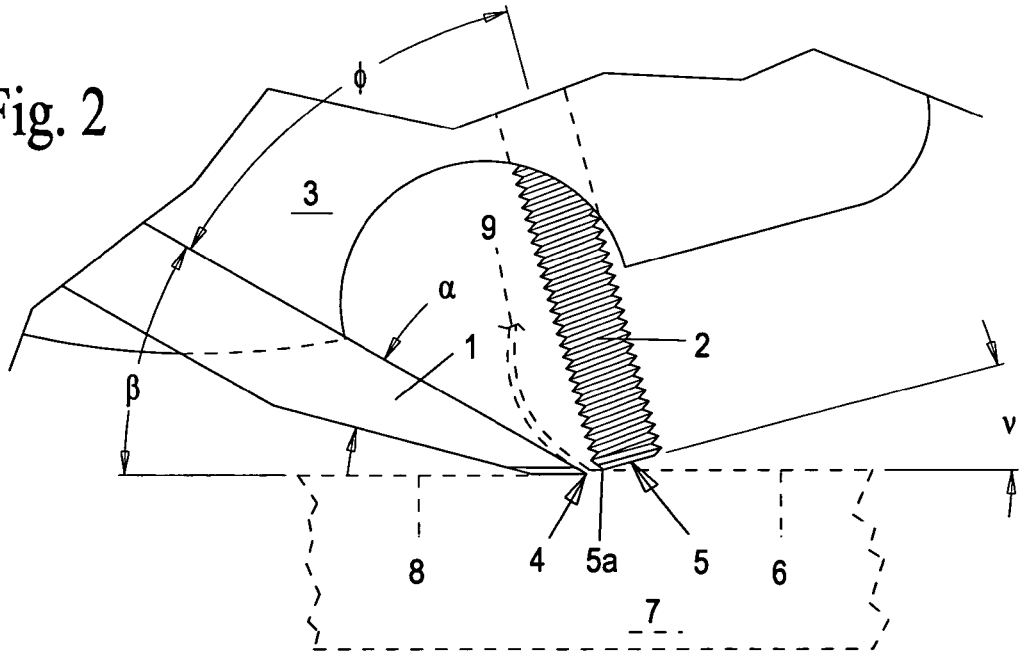
FIG. 2 is an enlarged side elevation of the same blade and regulating post, in the same positional relationship to each other, but tilted backward (counterclockwise rotation in this view) with respect to the direction of forward travel (from left to right across the workpiece in this view) to the attitude that results in the maximum chip thickness.

Referring now to FIG. 2, the partial tool assembly of FIG. 1 is here shown in the attitude that results in maximum cutting depth and chip thickness. It has been tilted backwards (rotated counterclockwise as shown in this view) through an angle $\nu$, which is here shown as equal to the cutting edge relief angle $\mu$. For a mouth opening (the space between the cutting edge 4 and the outside edge 5*a* of the end surface 5 of post 2) of 0.030 inches, the cutting depth (and also the thickness of chip 9) is equal to 0.030 tan $\nu$, or about 0.008 inches. It should be noted that the depth of cut is merely limited by post 2, but not controlled by post 2, whenever the angle $\nu$ equals or exceeds the angle $\mu$.

When $\nu$ is equal to $\mu$, the path of cutting edge 4 of blade 1 is controlled by contact of cutting edge bevel $\beta$ with freshly cut surface 8 of workpiece 7. The angular difference $\gamma$ between the primary and secondary sharpening bevels of cutting blade 1 provides "heel" clearance when working on a surface 6 that is concave. If a discontinuous depression deeper than the cutting depth into surface 6 is encountered, the cutting path will not follow it, but rather will continue on the current cutting path 8 until it clears through the depressed area in surface 6 of workpiece 7. If the attitude of the tool is not changed, the cut cannot resume until the far side of the depression is reached and the local positive slope of its surface diminishes to a value equal to or less than the angle $\nu$, so that the cutting edge 4 of blade 1 can again contact surface 6 of workpiece 7. This sequence of events will occur each time the tool encounters the depression, until the depth of the depression below the surface of the surrounding area 6 of workpiece 7 is reduced to an amount less than the cutting depth of the tool, whereupon the next pass of the tool will establish a smoothly faired continuous contour for the surface 8 of workpiece 7.

Figure 3:
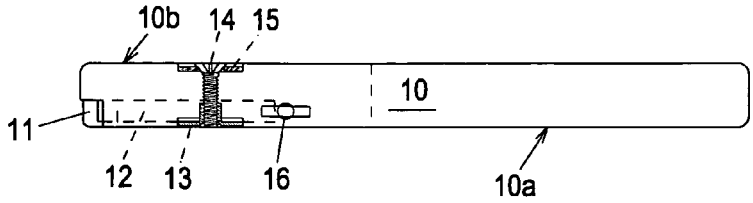
FIG. 3 is a plan view of a first embodiment of the invention. For clarity, and because broken lines are impractical to clearly depict such small elements, the blade-clamping fastener assembly only is shown in partial section, as if the body member were transparent.
Figure 4:
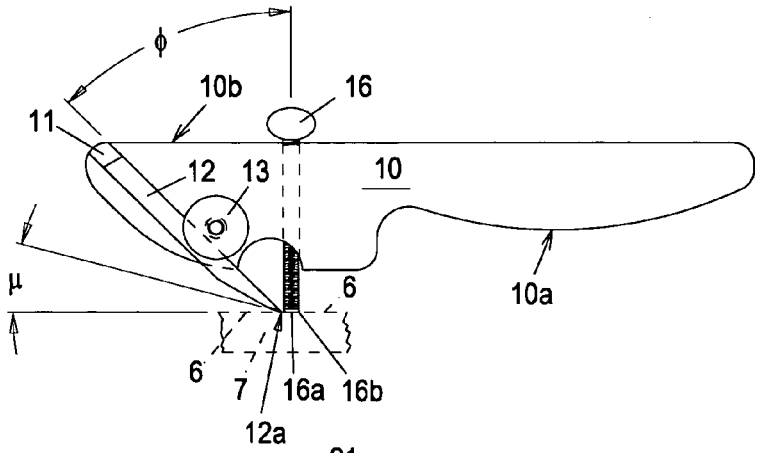
FIG. 4 is an elevation view of the same first embodiment shown in FIG. 3. For clarity, and because there is no ambiguity, the broken section line and arrows indicating the viewing direction have been omitted regarding FIG. 3.

Referring now to FIG. 3 and FIG. 4, an embodiment of the invention is shown comprising a one-piece body 10 of hardwood, molded plastic, die-cast metal, or other suitable material having approximate dimensions of 0.75 inch thickness by 1.50 inches height by 7.75 inches length overall. One end 10*a* of the body 10 is shaped to provide a handle that affords a comfortable and ergonomic grip for any hand, whether small, average, or large. The other end 10*b* is rounded at the bottom to provide clearance when the tool is used within deep concave contours. There is a groove 11 of 0.253 inches width by 0.31 inches depth at an angle $\phi$ of approximately 45° from vertical in the left (near) side of body 10 to locate cutting blade 12, which is ground and honed from a standard industrial tool bit of High Speed Steel, Tungsten Carbide, or other ultra hard cutting tool material. Such tool bits are inexpensive and commonly available as pre-ground blanks 0.250 inches square by 2.50 inches overall rough length, ready for grinding and honing to the required cutting edge geometry.

Cutting blade 12 protrudes from the bottom end of the groove 11, facing backwards at angle $\phi$, which is approximately 45°. Blade 12 is clamped solidly in place by a single, overlapping, standard size #10-24 tee-nut 13 and a #10-24 by 0.75 inches length flat head machine screw 14 seated in a standard size "quarter-inch" flat washer 15, whose actual size is 0.75 inches OD by 0.31 inches ID by 0.06 inches thickness. Flat washer 15 is seated in a 0.75 inches diameter by 0.10 inches depth recess in the right (far) side of body 10. Tee-nut 13 operates within a similar recess in the left (near) side of body 10, but is seated against the near side of blade 12 rather than the bottom of the recess.

In manufacturing cutting blade 12, the end of a standard ground blank tool bit is first ground to a primary included angle $\alpha$ of approximately 15°, and the secondary bevel is then ground and honed to an included angle $\beta$ of approximately 30° to produce the sharp cutting edge. The initial length of the secondary bevel, as measured from the cutting edge 12*a* back to the intersection with the primary bevel, is typically about 0.06 inches, but it will become longer each time the blade 12 is re-sharpened by grinding and/or honing the secondary bevel. As the length of the bevel increases, the tool becomes more able to smooth-out variations in surface contour, but is less able to cut smoothly in concave areas of small radius. The particular cutting conditions determine the optimum length for this bevel, but it is not at all critical for most typical work if the length of the secondary bevel is less than 0.25 inches.

A #10-32 by 2.00 inches length, fully threaded, standard thumbscrew 16 in a threaded hole inset 0.188 inches from the left (near) side of body 10 extends completely through body 10 from top to bottom, with its end 16*a* in close proximity to, and nominally centered on the width of the cutting edge 12*a* of blade 12. The end 16*a* of thumbscrew 16, which serves as the toe portion of the sole of the shave, is preferably ground flat and perpendicular to the axis of the screw, but alternatively may be left in the "as formed" condition, which is generally concave with a raised rim 16*b* defining a plane that is perpendicular to the axis of the screw. Since the size of end 16*a* is small in comparison to the radius of curvature of any typical contour that will be worked, concavity or slight convexity of 16*a* is virtually irrelevant, provided that the outside edge 16*b* of end 16*a* is uniform and the plane defined by this edge is perpendicular to the axis of the thumbscrew 16. The cutting edge 12*a* of blade 12 is typically positioned approximately 0.03inches away from edge 16*b* of end 16*a* of thumbscrew 16, but this gap may be made smaller or larger to alter the cutting response of the tool to changes in angle $\nu$ (as previously defined in FIG. 2). For reference, a partial workpiece 7 is shown in phantom (as depicted already in FIG. 1), with the tool just touching surface 6 of workpiece 7, but not yet tilted to begin cutting.

In general, widening the gap between cutting edge 12*a* and edge 16*b* causes the tool to become more aggressive in stock removal and better suited to roughing work. Closing this gap makes the tool more controllable and easier to use for finishing work. Thumbscrew 16 is typically positioned initially to align the plane of its end surface 16*a* with cutting edge 12*a*, but its threads permit "fine tuning" to directly alter the effective exposure of cutting edge 12*a* and thereby to directly alter the cutting depth without changing the "feel" of the cutting action. Whatever the initial setting of the mouth opening (gap), thumbscrew 16 can be easily adjusted to compensate for varying cutting conditions, such as wood hardness or cutting edge sharpness, as the work progresses.

Figure 5:
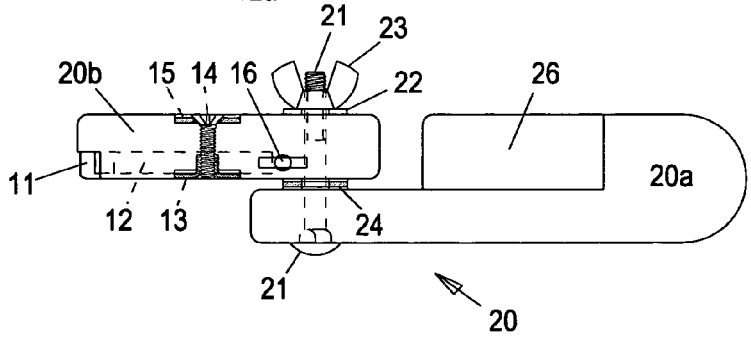
FIG. 5 is a plan view of a second embodiment of the invention. For clarity, and because broken lines are impractical to clearly depict such small elements, the blade-clamping fastener assembly only is shown in partial section, as if the body member were transparent.
Figure 6:
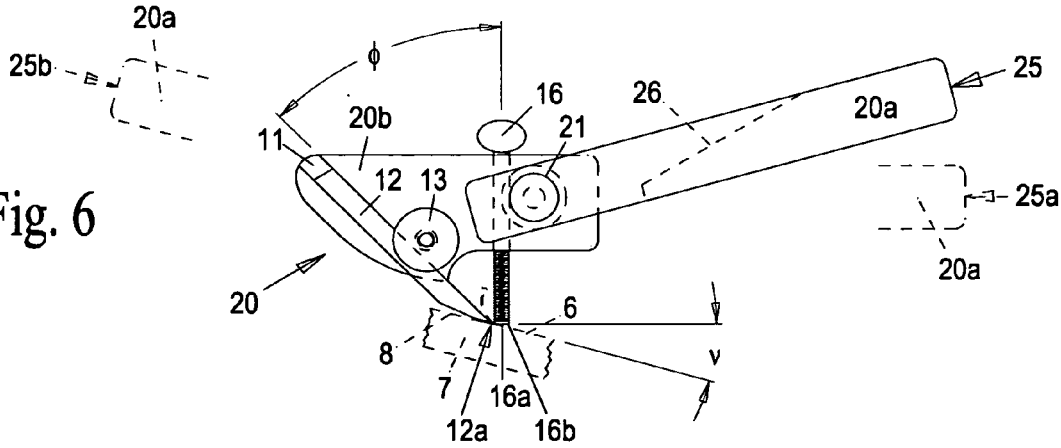
FIG. 6 is an elevation view of the same second embodiment shown in FIG. 5. For clarity, and because there is no ambiguity, the broken section line and arrows indicating the viewing direction have been omitted regarding FIG. 5.

Referring now to FIG. 5 and FIG. 6, a second embodiment of the invention is shown comprising a two-piece body or housing assembly 20 of hardwood, molded plastic, die-cast metal, or a combination of these or other materials, with the handle portion 20*a* and the main portion 20*b* joined to each other by a single carriage bolt 21, flat washer 22, and wing nut 23. Appropriate friction washers 24 between body portions 20*a* and 20*b* permit the handle portion 20*a* to be positioned and locked at any convenient angular position 25, between 25*a* (straight) and 25*b* (fully folded) with respect to the main portion 20*b* for cutting inside deep hollows or other confined spaces. The handle portion 20*a* is relieved in area 26 to permit counterclockwise rotation (folding) of the handle portion 20*a* to within 15° of horizontal. In this position 25*b*, the entire assembly 20 can be turned 180° around its vertical axis for one-handed use as a push plane where there is limited clearance for the handle 20*a* in the pull-cutting configuration.

Again, for reference and to illustrate the fundamental relationship of the tool and workpiece during the cutting process, a partial workpiece 7 is shown in phantom in FIG. 6 tilted to an angle $\nu$ required for cutting edge 12*a* to cut into surface 6 and generate a new surface 8. With respect to the location of the thumbscrew 16 and the position and angle $\phi$ of the cutting blade 12, the geometry of the main portion 20*b* of this embodiment and the clamping means for blade 12 are the same for both the one-piece body and handle design 10 (FIG. 3 and FIG. 4) and the two-piece body and pivoting handle assembly 20 (FIG. 5 and FIG. 6). Both embodiments may be used interchangeably whenever there is no interference of the workpiece with the fixed handle portion 10*a* of the first embodiment. This ability is advantageous in prolonged work sessions, where the slightly different hand gripping positions serve to prevent the hand cramping that can occur when holding any single object tightly for a long period of time without relief. Also, both embodiments of the invention can be held and used with equal effectiveness by either the right or the left hand. This can be a very important advantage when working on portions of a contoured surface offering limited access, in addition to the obvious matter of the user being either naturally right or left handed.

Referring now to FIG. 7 and FIG. 8, another embodiment of the invention is shown comprising a two-piece body assembly 30 of hardwood, molded plastic; die-cast metal or some combination of these or other suitable materials. Handle portion 30*a* and main portion 30*b* are joined together by a single oval-head machine screw 17, seated in trim washer 18, and engaging threaded cross dowel 19. This permits the two parts to be relatively rotated in either direction about the inclined axis of screw 17 and locked for use on the lateral surfaces of deep cavities and other confined spaces, providing both hand clearance and a skew-cutting action to the cutting edge 12*a* of blade 12. As in the two embodiments of the invention already described above, blade 12 is aligned and located in main body portion 30*b* by groove 11, and is clamped solidly in position by the same fastener assembly comprising tee nut 13, machine screw 14, and flat washer 15. Thumbscrew 16 is also the same as is used in these two embodiments, and its end surface 16*a* and surrounding edge 16*b* perform the same functions as described above. Again for reference, a partial workpiece 7 is shown in phantom, with its work surface 6 just touching cutting edge 12*a* and end surface 16*a* of thumbscrew 16.

Referring now to FIG. 9 and FIG. 10, another embodiment of the invention is shown comprising a body member 40 having a groove 11, cutting blade 12' clamped solidly in position by tee nut 13, machine screw 14, and flat washer 15, and also having thumbscrew 16 whose end surface 16*a* and surrounding edge 16*b* again perform the same functions already described above. Blade 12' differs from blade 12 only in that its cutting edge 12*a'* is ground and honed straight across rather than crowned as is the cutting edge 12*a* of blade 12 (for cutting chips cleanly from a broad surface without leaving ragged edges and corner dig marks) because this embodiment is adapted for the particular task of chamfering sharp 90° edges, whether straight or curved, to chamfer sizes less than the width of the blade 12'.

In order to facilitate following a sharp or narrow edge and maintain constant dimensions of the finished chamfer, it is necessary to add only a simple guide. A bar 41, which is 0.250 inches square by 2.50 inches length, with a 90° V-notch 41*a* centered in its end serves this purpose. Bar 41 is aligned and located by a groove in the left (near) side of body 40 and clamped fixedly in place by a fastener assembly (identical to that used for blade 12') comprising tee nut 13', machine screw 14', and flat washer 15'. To place the V-notch 41*a* closely proximate to the end surface 16*a* of thumbscrew 16, yet provide ample clearance for the wings of thumbscrew 16 at the top of body 40, the groove and bar 41 are tilted clockwise approximately 10°; i.e., angle $\phi$ is approximately 80°. For reference, a workpiece 7' is shown with its 90° (nominal) sharp edge 6' within the V-notch 41*a* and just touching the edge 16*b* of end surface 16*a* of thumbscrew 16, and with cutting edge 12*a'* making a chip and thereby creating newly cut chamfer surface 8' just behind it.

Referring now to FIG. 10A, the V-notch 41*a* in the end of guide bar 41 is shown positioned in relation to the cutting edge 12*a'* to generate a 45° chamfer of 0.125 inches width when the tool is moved along any straight or curved 90° edge, such as the edge of a board or a profile shape jig-sawed or band-sawed from flat stock or sheet. It should be noted that the thumbscrew 16 initially controls the depth of cut per pass, while the V-notch 41*a* serves only to keep the tool approximately centered on the edge being worked. However, when the chamfer becomes wide enough for both orthogonal faces of the workpiece to contact both sides of the V-notch 41*a*, further stock removal can only occur until the backward tilt $\nu$ of body 40 equals the angle $\mu$ (as defined in FIG. 1). Thus, both stock removal per pass and the size of the finished chamfer are independently controlled and fully adjustable, so even problem woods with wild grain can be accurately chamfered without the problem of tear-out that plagues all other cornering (rounding or chamfering) tools unable to control the depth of cut per pass.

Referring now to FIG. 11 and FIG. 12, another embodiment of the invention is shown comprising a rigid body member 50 of hardwood or other suitable material, with a ball 50*a* (also of hardwood or other suitable material) attached solidly to body 50 by dowel 50*b* and glue. A slot 51 of 0.128 inches width by 0.500 inches depth and inclined at the angle $\gamma$ (shown here as approximately 15°) is provided in the left (near) side of body 50 to align and locate cutting blade 52, which is clamped solidly in place by fastener assembly 54 (identical to those used in the four other embodiments described above) comprising tee nut 13", machine screw 14", and flat washer 15". Blade 52 is made from an industry standard 0.5 inches width by 0.125 inches thickness by 4.00 inches length blank tool bit of High Speed Steel, Tungsten Carbide, or other ultra-hard cutting tool material, and its cutting edge 52*a* is ground and honed to the same $\alpha$ primary and $\beta$ secondary bevel angles as employed in the 0.250 inches square blades elsewhere described within this specification. Thumbscrew 53, its end surface 53*a*, and surrounding edge 53*b* may be, but are not necessarily identical to the thumbscrews used in all the other embodiments of the invention already described above, as is the angle $\phi$ between the centerline of thumbscrew 53 and blade 52.

Although the embodiments of the invention already described are all designed to cut when pulled, this alternate embodiment is designed to cut when pushed. To illustrate the relationship of the tool and the workpiece, a partial workpiece 7' is shown with its existing surface 6' in contact with edge 53*b* of end surface 53*a* of thumbscrew 53, and cutting edge 52*a* of blade 52 cutting at maximum depth to expose freshly cut surface 8' of workpiece 7'. It should be noted that the attitude of the tool, as measured by the angle $\nu$ between the surface 6' of workpiece 7' and the plane of end surface 53*a* of thumbscrew 53, is the same as in the other embodiments when any of them is performing a maximum depth cut.

Referring now to FIG. 13 and FIG. 13A, there is shown a partial side elevation and a partial front elevation of a typical cutting blade as used in embodiments of the invention. No linear dimensions are given because they are arbitrary and can be chosen as may be appropriate for any given application requirements. However, the angular dimensions of the primary and secondary sharpening bevels are essentially the same for all cutting blades, regardless of their linear dimensions. Primary bevel angle $\alpha$ is approximately 15° nominal, and secondary bevel angle $\beta$ is approximately 30° nominal, although these values are not critical. For example, the angle $\beta$ may be reduced to make the blade "sharper" (which reduces the cutting force requirement), but this also reduces the angle $\gamma$ (which reduces the effective heel clearance of the tool) and may make the tool unusable inside some deeper concave areas of a contoured surface due to interference.

FIG. 13A shows the crowned cutting edge that is preferred for most applications of the embodiments of the invention, with the exception of the fourth embodiment described above, which is used only for chamfering 90° edges at 45° and requires a straight cutting edge to produce a flat chamfer. The curvature $\rho$ of the cutting edge may be chosen as required by the application conditions, but in general, $\rho$ must always be less than the minimum radius of concave curvature of the surface of a workpiece, to prevent the corners of the blade from leaving sharp grooves or dig-marks in the surface. A good rule of thumb is to choose $\rho$=twice the cutting width of the blade. For most work, $\rho$ be in the range of 0.125 inches to 2.00 inches, with $\rho$=0.5 inches being typical for general use. A blade 0.25 inches width with $\rho$=0.125 is able to cut cleanly even when tilted 45° to either side, which is very useful in shaving the sides of cavities or grooves that are both narrow and deep. A very useful crown for all around best utility is a combination grind with $\rho=0.50$ inches and the corners removed by blending to a smaller radius.

It is of course possible to grind and hone the cutting edge with a negative crown; i.e., in the form of a quarter-circle notch having radius of curvature $\rho$ and arc length $\pi\rho/2$. If the notch radius is $\rho=0.125$ inches, this blade may be used in the above described fourth embodiment of the invention (instead of blade 12' having a straight cutting edge 12'*a*) to shave a perfect 0.125 inch radius (instead of a straight 45° chamfer) on any straight or curved 90° edge. A blade, having a quarter-circle notch of radius $\rho=0.06$ inches, arc length $\pi\rho/2=3.1416*0.06/2=0.094$ inches, and installed in the fourth embodiment of the invention, is the ideal tool for use by furniture builders and finish carpenters to quickly shave a clean, uniform radius on all sharp or ragged edges of trim boards, molding, shelves, casings, etc. in preparation for final sanding and finishing.

It should be emphasized here that there are many possible variations of design and construction of the elements of the embodiments of the invention in addition to those embodiments thus far described herein. For example, if the body is made of metal (which is much stronger than wood) the hand tool can be much smaller and can provide more operating clearance in very tight quarters. This can also offer more freedom to optimize the ergonomics of the tool by possibly providing a more comfortable hand position when gripping it. Another embodiment illustrating the combination of a machined aluminum body with an adjustable wooden handle is shown in FIGS. 14 and 15, which are plan and elevation views respectively of this hand tool.

Figure 14:
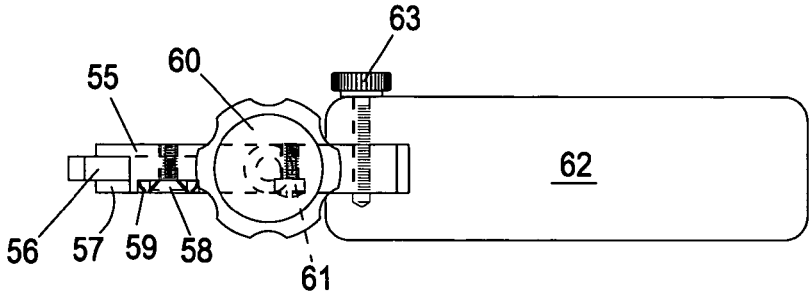
FIG. 14 is a plan view of another embodiment of the invention.
Figure 15:
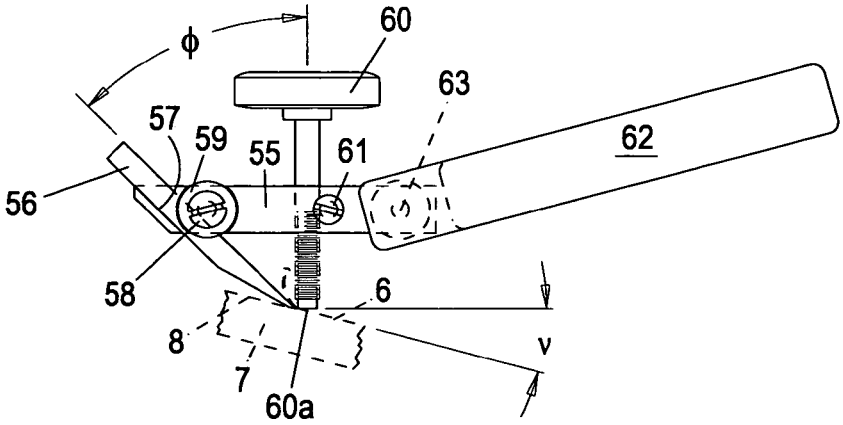
FIG. 15 is an elevation view of the embodiment of the invention shown in FIG. 14.

Referring now to FIG. 14 and FIG. 15, the body 55 material is one-half inch square extruded aluminum alloy, cut to a length of 3.12 inches. A 0.250 inch square×2.50 inch length cutting blade 56 is clamped in groove 57 by a #10-32×0.50 inch length flat head machine screw 58 and a metal standard #10 cup washer 59. The angle $\phi$ of the blade is typically 45° from the vertical axis of thumbscrew 60, whose end surface 60*a* is shown tilted back at angle $\nu$ with respect to and in contact with work surface 6 of work piece 7. The high strength of the metal body permits the depth of groove 57 to be deep enough (0.37 inch) to align the blade 56 with the centerline of body 55 and thumbscrew 60. This is desirable because symmetry makes the shave equally well suited for use with either the right or the left hand. Thumbscrew 60 is held from turning freely by means of a standard molded Nylon slotted fillister head machine screw 61 tightened to provide the appropriate amount of friction against the threads of thumbscrew 60 to allow intentional adjustment but prevent incidental movement. Ideal balance is maintained by mounting handle 62 also in alignment with the centerline of body 55 by means of clamping thumbscrew 63 engaging the #10-32 threads tapped in body 55. It should be noted that this screw is capable of friction-locking handle 62 to body 55 at any convenient working angle within the quadrant of ergonomic use for most carving applications. It should also be noted that torque resulting from cutting forces acts in the direction that causes relative motion of the threaded members to increase the clamping force if any joint slippage occurs.

While threaded regulating posts have been shown and described with respect to all the embodiments, there are other constructions that can provide both adjustability and similar function. Generally, they are not as simple or inexpensive to make and/or to use as are standard thumbscrews or machine screws. Therefore, other alternative means are not now shown in the embodiments of the invention, even though they are intended to fall within its scope. It should be obvious to anyone skilled in the art that there are many specialized applications of the embodiments of the invention quite unrelated to wood carving that can benefit from other embodiments vastly different in appearance, size, and proportion from those described herein, and yet can employ the same underlying principles, knowledge, and understanding of the cutting process that is taught within this disclosure.

Other aspects, modifications, and embodiments are within the scope of the following claims.

What is claimed is:

1. A hand tool, comprising:

a housing, comprising a handle portion and a working portion;

a blade rigidly mounted in and protruding from the working portion of the housing, said blade having a sharp cutting edge at the protruding end, said cutting edge being visible while making a cut; and a regulating post both rigidly and adjustably mounted in and protruding from the working portion of the housing, said regulating post being located between said blade and said handle portion, said regulating post having a non-cutting workpiece-engaging surface at its outer protruding end that is proximate to the blade relative to the handle portion but spaced apart from and generally aligned with said cutting edge of said blade, said blade being angled toward the workpiece-engaging surface of the regulating post such that an included angle between the blade and a vertical axis of the regulating post is acute, said regulating post limiting the maximum depth of a cut of said blade, and wherein, only said blade and said regulating post contact the workpiece surface when material from said surface is being removed.

2. The hand tool of claim 1, wherein the distance between the cutting edge and a proximate portion of the regulating post is approximately in the range of 0.0002 meters (0.010 inches) to 0.0007 meters (0.030 inches).

3. The hand tool of claim 1, wherein the distance between the cutting edge and a proximate portion of the regulating post is in the range of approximately 0.003 meters (0.125 inches) to 0.0008 meters (0.035 inches).

4. The hand tool of claim 1, wherein the blade further comprises a primary flat bevel and a secondary cylindrical bevel that defines a crowned cutting edge.

5. The hand tool of claim 4, wherein the primary flat bevel of said cutting edge is in the range of approximately 20 to 30 degrees.

6. The hand tool of claim 1, wherein the working portion is made from one of metal and wood.

7. The hand tool of claim 1, wherein the cutting blade is made from a standard sized, industrial, pre-hardened and pre-ground blank tool bit.

8. The hand tool of claim 1, wherein the blade is a chisel.

9. The hand tool of claim 6, wherein the working portion is made from an aluminum alloy.

10. The hand tool of claim 1, wherein the protrusion length of the regulating post is adjusted to change the thickness of shavings removed from said workpiece surface.

11. The hand tool of claim 1, wherein the angle between the blade and the vertical axis of the post is approximately 45°.

12. The hand tool of claim 1, wherein the angle between the blade and the vertical axis of the post is in a range between 30° and 60°.

13. The hand tool of claim 1, wherein the blade has a heel clearance with respect to a workpiece surface to optimize one of a contouring and cutting function.

14. The hand tool of claim 13, wherein the heel clearance is in the range of approximately 15° to 30°.

15. The hand tool of claim 1, wherein the distance between the cutting edge and a plane defined by the surface of the working portion from which both the blade and the regulating post protrude is approximately greater than 0.006 meters (¼").

16. The hand tool of claim 1, wherein the distance between the cutting edge and a plane defined by the surface of the working portion from which both blade and regulating post protrudes is in the range of approximately 0.0096 meters to 0.022 meters (⅜" to ⅞").

17. The hand tool of claim 1, wherein the distance between the cutting edge and a plane defined by the surface of the working portion from which said blade and regulating post protrude is in the range of approximately 0.012 meters to 0.015 meters (½"–⅝").

18. The hand tool of claim 1, wherein said housing further comprises a lateral guide member that is adjustably mounted thereon.

19. The hand tool of claim 18, wherein the said housing adjustably locates and holds fixedly the lateral guide member in the form of a 90° V in close proximity to the workpiece-engaging surface of the said regulating post, and the blade has a primary flat bevel and a secondary flat bevel that defines a straight cutting edge.

20. The hand tool of claim 1, wherein the said housing adjustably locates and holds fixedly a lateral guide member in the form of a 90° V in close proximity to the workpiece-engaging surface of the said regulating post, said blade having a primary flat bevel and a secondary flat bevel that defines a straight cutting edge that is centrally notched at the said secondary flat bevel angle with a quarter-circle arc of arbitrary radius.

21. The hand tool of claim 1, wherein the housing further comprises two principal independent pieces joined by a single fastener means that permits relative movement when loosened and fixes both pieces rigidly in relative position when tightened.

* * * * *